United States Patent [19]

Ducolon, Jr.

[11] Patent Number: 5,014,595

[45] Date of Patent: May 14, 1991

[54] REDIRECTED RECOIL MECHANISM

[76] Inventor: Fredric D. Ducolon, Jr., 5303 Pacific Hwy. East, Ste. 172, Fife, Wash. 98424

[21] Appl. No.: 415,851

[22] Filed: Oct. 2, 1989

Related U.S. Application Data

[63] Continuation-in-part of Ser. No. 194,526, Sep. 16, 1988, abandoned.

[51] Int. Cl.[5] ..... F41A 25/10

[52] U.S. Cl. ..... 89/44.01; 89/198; 89/178

[58] Field of Search ..... 89/165, 167, 168, 44.01, 89/178, 177, 194–199

[56] References Cited

U.S. PATENT DOCUMENTS

| | | | |
|---|---|---|---|
| 4,471 | 7/1881 | Eads | 89/44.01 |
| 347,945 | 8/1886 | Maxim | 89/44.01 |
| 789,806 | 5/1905 | Haussner | 89/44.01 |
| 2,564,360 | 8/1951 | Hammar et al. | 89/44.01 |
| 4,012,860 | 3/1977 | Auger | 42/94 |

FOREIGN PATENT DOCUMENTS

| | | | |
|---|---|---|---|
| 199683 | 6/1908 | Fed. Rep. of Germany | 89/44.01 |
| 392570 | 11/1908 | France | 89/44.01 |
| 17165 | of 1906 | United Kingdom | 89/44.01 |
| 349211 | 5/1931 | United Kingdom | 89/37.05 |

*Primary Examiner*—Deborah L. Kyle
*Assistant Examiner*—Stephen Johnson
*Attorney, Agent, or Firm*—Glenn D. Bellamy

[57] ABSTRACT

The present invention provides a recoil-redirecting mechanism for a gun which includes a frame, a gun barrel assembly having a barrel and a receiver with a bolt therein. The gun barrel assembly is slidably mounted to longitudinally reciprocate on the frame between a forwardmost position and a rearwardmost position. Means for firing the gun when the gun barrel assembly is substantially at its forwardmost position is provided. The recoil-redirecting mechanism includes a recoil-absorbing spring, a fixed pulley mounted on the frame, and a travelling pulley mounted on a longtudinally-reciprocating block which is longitudinally slidable relative to the frame substantially parallel to and independent from the gun barrel assembly. A cable having a first end fixed relative to the frame operably extends over and is reversed in direction by the travelling pulley, further extends over and is reversed in direction by the fixed pulley, and has a second end fixed to the gun barrel assembly. The spring biases the gun barrel assembly and reciprocating block so that, when the gun is fired, the gun barrel assembly recoils rearwardly exerting rearwardly-directed force on the spring and the second end of the cable means. The cable means, in turn, exerts force on the pulleys to thereby cause the block to slide forwardly and to exert forwardly-directed force on the spring. An alternative embodiment provides a fixed gun barrel assembly with a blowback bolt.

6 Claims, 2 Drawing Sheets

REDIRECTED RECOIL MECHANISM

RELATED APPLICATIONS

This application is a continuation-in-part of U.S. patent application Ser. No. 07/194,526, filed Sept. 16, 1988, now abandoned.

TECHNICAL FIELD

This invention relates to a gun having a mechanism for redirecting the recoil associated with firing the gun. In particular, this invention relates to such a mechanism which includes a compound pulley arrangement to transfer recoil energy to an energy-absorbing spring.

BACKGROUND INFORMATION

A basic law of physics is that every action has an equal and opposite reaction. The reaction, or recoil, of firing a large caliber gun can be quite significant and undesirable.

Mechanisms have been made which store up the energy produced by a recoiling gun part in a spring or similar shock absorber. The shock absorbing spring may be situated to absorb the recoil directly, as shown in U.S. Pat. No. 2,564,360, or indirectly by transfer through cables and pulleys, as shown in U.S. Pat. No. 789,806. That patent also teaches the use of helicoidal pulleys so that the power transmitted between the gun barrel assembly and the spring is gradually changed in the same proportion as the spring compression increases, so as to cause an almost uniform resistance to act upon the gun barrel assembly throughout the cycle of its recoil.

However, the stroke of the reciprocating gun part may be shortened by providing a recoil-redirecting or absorbing mechanism which absorbs the recoil energy at an increasing rate during the recoil cycle.

DISCLOSURE OF THE INVENTION

The present invention provides a mechanism which, rather than providing a linear or directly proportional transfer of power from the recoiling gun barrel assembly to a spring means, provides a non-linear transfer which increases the absorption of energy as the recoiling gun part reaches the full extent of its recoil stroke.

This is achieved by providing a recoil-redirecting mechanism in a gun having a frame, a gun barrel assembly, a firing means, and a recoil-redirecting mechanism. The gun barrel assembly includes a barrel and a receiver having a bolt therein. The gun barrel assembly is slidably mounted to longitudinally reciprocate on the frame. The recoil-redirecting mechanism includes a recoil-absorbing spring means, a fixed pulley mounted on the frame, and a travelling pulley mounted on a longitudinally reciprocating block. The block is longitudinally slidable relative to the frame, substantially parallel to and independent from the gun barrel assembly. A cable means, having a first end fixed relative to the frame, operably extends around and is reversed in direction by the travelling pulley. The cable means further extends around and is reversed in direction by the fixed pulley. A second end of the cable means is fixed to the gun barrel assembly. A spring means biases the gun barrel assembly and the reciprocating block so that, when the gun is fired, the gun barrel assembly recoils rearwardly exerting rearwardly-directed force on the spring means and the second end of the cable means. The cable means, in turn, exerts force on the pulleys to thereby cause the block to slide forwardly and to thereby exert forwardly-directed force on the spring means. This mechanism provides an increasing absorption of recoil by the spring means.

The spring means may be in the form of a helically-coiled spring situated either forwardly of or rearwardly of the reciprocating block to absorb recoil force by either compression or extension, respectively.

The reciprocating block may be selected to have a mass of predetermined size. The mass of the reciprocating block is moved forwardly, as the gun barrel assembly recoils in response to the gun being fired, to forwardly counterbalance the frame and at least partially counteract muzzle climb.

The frame may be provided with an upwardly-extending portion having an outward end which is contacted by the reciprocating block as it reaches its forwardmost position. The impact of the forwardly-moving block transfers a portion of the recoil energy to the frame portion to at least partially counteract muzzle climb.

An alternate firing sequence may be implemented by providing a means for holding the gun barrel assembly at its rearwardmost position, thereby storing energy in the spring means. When the gun barrel assembly is released, it is slid forwardly by the spring means and the firing means operates to fire the gun as the gun barrel assembly substantially reaches its forwardmost position. The gun barrel assembly may be moved manually to the rearwardmost position for firing, or moved as a result of the recoil associated with firing the gun. The gun barrel assembly may be allowed to return to its forwardmost position after firing from either the forward or rearward firing position.

An alternate embodiment of the invention provides a gun having a barrel and receiver which are fixed in place and includes a blow back bolt slidably mounted to longitudinally reciprocate within the receiver between a forwardmost position and a rearwardmost position. A means is provided for firing the gun when the bolt is substantially at its forwardmost position. A recoil-redirecting mechanism includes a recoil-absorbing spring means, a fixed pulley which is fixed relative to the barrel and receiver, and a travelling pulley mounted on a longitudinally-reciprocating block which is longitudinally slidable substantially parallel to and independent from the barrel and receiver. A cable means extends from a first end which is fixed relative to the barrel, and receiver, operably extends over and is reversed in direction by the travelling pulley, and further extends over and is reversed in direction by the fixed pulley. A second end of the cable means is fixed to the bolt. The spring means operates to bias the bolt and reciprocating block so that, when the gun is fired, the bolt recoils rearwardly exerting rearwardly-directed force on the spring means and the second end of the cable means. The cable means in turn exerts force on the pulleys to thereby cause the block to slide forwardly and to exert forwardly-directed force on the spring means.

BRIEF DESCRIPTION OF THE DRAWINGS

Like reference numerals are used to represent like parts throughout the various figures of the drawings in which.

BEST MODE FOR CARRYING OUT THE INVENTION

Figure 6:
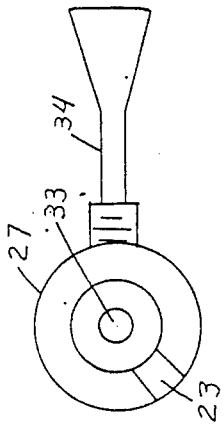
FIG. 6 is a rear view of the firing pin and bolt assembly taken substantially along line 6—6 of FIG. 4.
Figure 4:
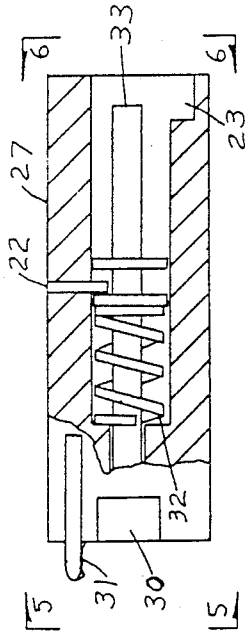
FIG. 4 is a partially cut-away side view of a gun bolt assembly with a central firing pin assembly.
Figure 5:
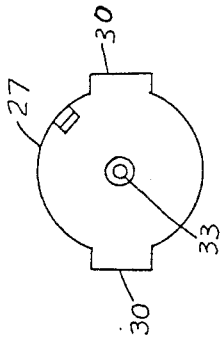
FIG. 5 is a front view of the bolt assembly taken substantially along line 5—5 of FIG. 4.
Figure 1:
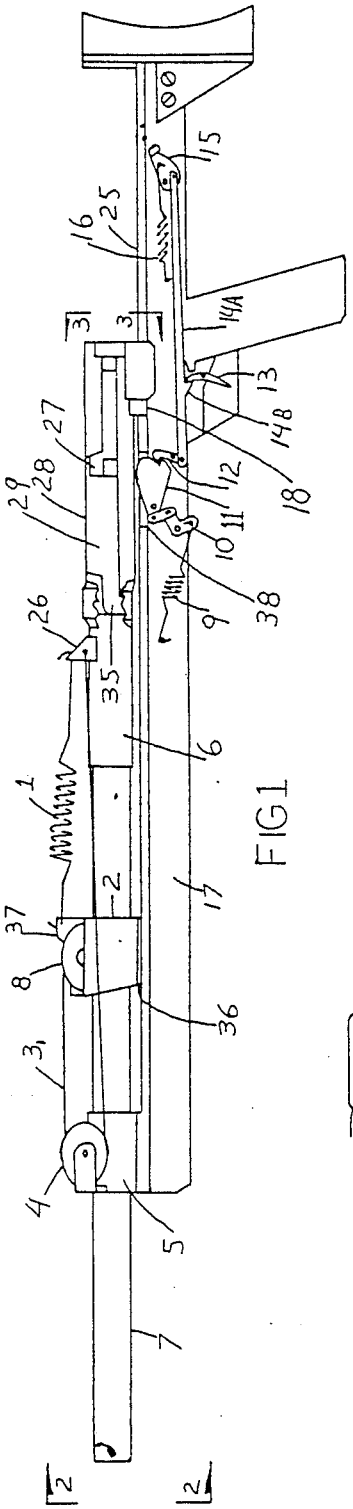
FIG. 1 is a side plan view of a recoil-redirecting gun according to the preferred embodiment of the invention.

Referring to the several figures of the drawing, and first to FIG. 1, therein is shown a gun which includes a recoil-redirecting mechanism according to the preferred embodiment of the invention. The gun includes a frame 17 which operates as a track for a longitudinally-reciprocating gun barrel assembly which is slidably mounted thereon. The gun barrel assembly includes a gun barrel 7 with a shell chamber housing 6 and a receiver 28. The barrel 7, shell chamber housing 6 and receiver 28 are all rigidly secured to one,. another to form the gun barrel assembly. Mounted to the forward end of the frame 17 is a sleeve 5 which supports the barrel 7 for longitudinal reciprocation. At the rearward end of the receiver 28 are longitudinal guides 24 which support and guide the gun barrel assembly on a horizontal plate or track 25 which is part of the frame 17.

Figure 3:
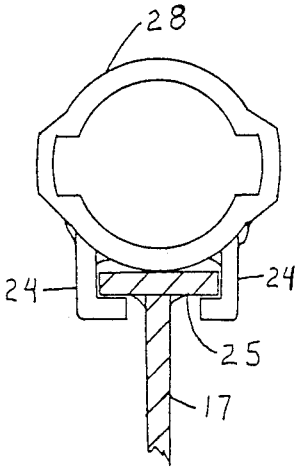
FIG. 3 is a fragmentary cross-sectional view taken substantially along line 3—3 of FIG. 1.
Figure 2:
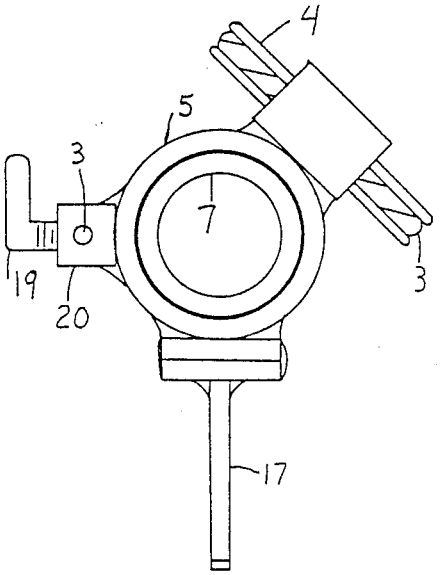
FIG. 2 is a front view of the gun taken substantially along line 2—2 of FIG. 1.
Figure 7:
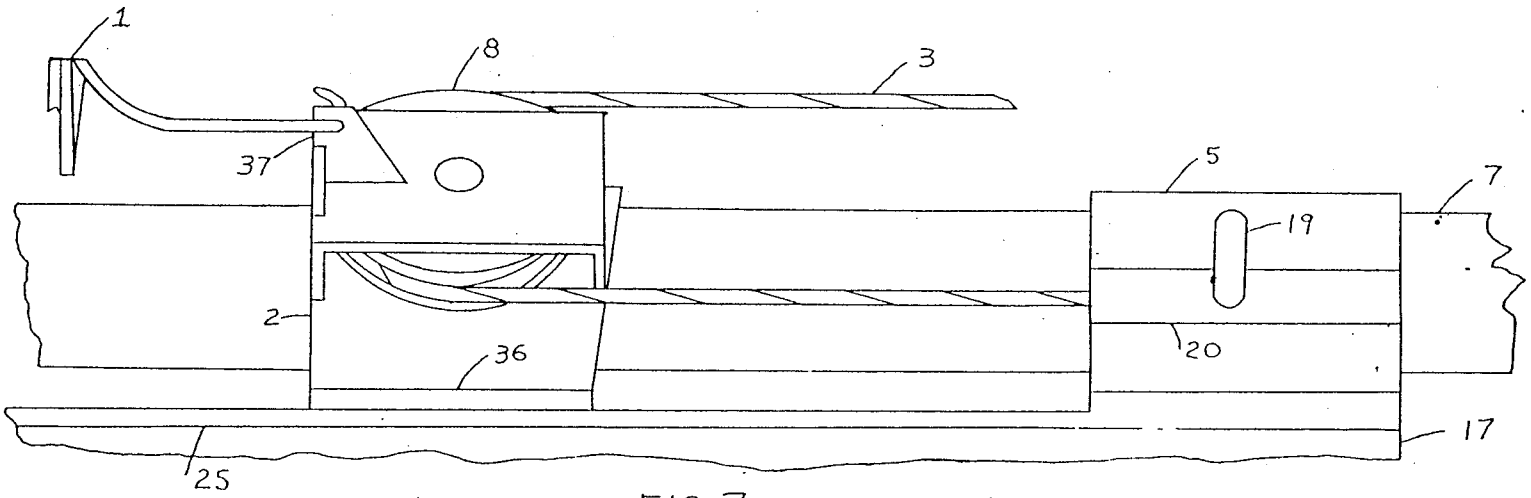
FIG. 7 is a fragmentary opposite side view of the gun shown in FIG. 1.
Figure 8:
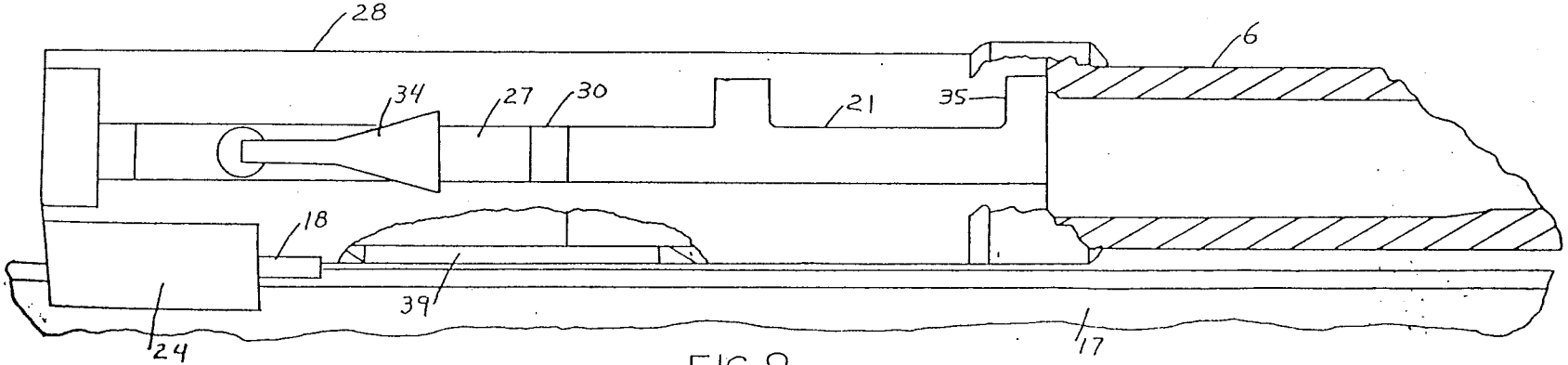
FIG. 8 is a fragmentary, partially cut-away opposite side view of the receiver and shell chamber housing of the gun shown in FIG. 1.

Referring now also to FIGS. 2 and 3, therein is shown the concentric arrangement of the gun barrel 7 and guide sleeve 5. The horizontal plate 25 mounted on the frame 17 forms a substantially T-shaped track. A pair of opposite longitudinal guides 24 extend downwardly from the receiver portion 28 of the gun barrel assembly on opposite sides of the horizontal track 25 and then extend inwardly thereunder to prevent separation of the gun barrel assembly from the track 25. At its forwardmost position, the longitudinal guides 24 rest against stop plates 18 which extend outwardly from opposite sides of the horizontal plate 25.

A reciprocating block or sleeve 2 is concentrically mounted on the gun barrel 7 and is longitudinally slidable thereon. The reciprocating sleeve 2 is located rearwardly of the guide sleeve 5 and forward of the receiver 28. The reciprocating sleeve 2 includes a base plate 36 which prevents the sleeve from rotating on the gun barrel 7. Alternatively, the reciprocating sleeve 2 could be mounted to slide upon the horizontal track 25 of the frame 17 in a manner similar to the that of the receiver 28.

Mounted to the guide sleeve 5 is a fixed pulley 4. Mounted to the reciprocating sleeve 2 is a travelling pulley 8. The pulleys 4, 8 are not mounted in the same plane. The pulleys 4, 8 are angularly mounted at opposite sides of the gun so that a single line spaced radially above the barrel 7 tangentially intersects an outer edge of each pulley 4, 8. Extending outwardly from the reciprocating sleeve 2 is a spring attachment flange 37. Extending outwardly from the shell chamber housing 6 is a spring/cable attachment flange 26. This spring/cable attachment flange 26 may be mounted at any convenient rearward point on the gun barrel assembly. Extending between the attachment flanges 26, 37 is a helical extension spring 1. This spring 1 operates to bias the gun barrel assembly forwardly until such point as the longitudinal guides 24 contact the stop plates 18. The spring 1 also biases the reciprocating sleeve 2 rearwardly. Also extending forwardly from the spring/cable attachment 26 is a flexible cable 3. This cable 3 extends forwardly to and around the fixed pulley 4 which reverses the direction of the cable 3. The cable 3 then extends to and over the travelling pulley 8 which again reverses the cable's direction. A second end of the cable 3 is attached to a cable anchor 20 which is fixed to one side of the guide sleeve 5. In preferred form, the cable 3 is adjustably attached through the cable anchor 20 by a set screw 19.

Within the receiver 28 is a longitudinally-slidable bolt 27 Referring now also to FIGS. 4–6 and 8, the bolt 27 includes outwardly-extending, diametrically-opposed locking lugs 30 which slide within longitudinal slots 21 formed in the receiver 28. Axially centered within the bolt 27 is a firing pin 33 which is biased rearwardly by a helical spring 32. Longitudinal movement of the firing pin 33 is limited by a stop pin 22 which contacts annular guide flanges on the firing pin 33. A longitudinal slot is formed on the exterior of the bolt 27 to attach a shell extractor 31 of well-known construction. A bolt handle 34 extends radially outwardly from the bolt 27 so that the bolt 27 may be longitudinally and rotatably manipulated. A portion of the receiver 28 is cut away to provide a receiver port 29 through which a shell is loaded or unloaded. The receiver port 29 is open when the bolt 27 is at its rearwardmost position. The shell may be introduced through the receiver port 29 and then moved into the shell chamber housing 6 by longitudinal forward movement of the bolt 27. At any position other than its forwardmost position, the bolt 27 is blocked from rotation by the locking lugs 30 which slide within the longitudinal slots 21. At the bolt's forwardmost position, the bolt 27 may be axially rotated by movement of the locking lugs 30 into radial slots 35. Only at this forwardmost, locked position does a bolt cutout 23 line up with receiver cutout 39 and horizontal plate cutout 38. In this position; a pivoting hammer 11, which is mounted to the frame 17, is permitted to swing through the cutouts 38, 39 and bolt slot 23 to strike the firing pin 33.

A firing mechanism is provided which includes a pivotable trigger 13, a transfer bar 14*a*, and hammer catch 12. As the trigger 13 is pivoted, it acts against a lip 14*b* on the transfer bar 14*a* to move the bar 14*a* forward, pivoting the hammer catch 12 away from its engaging position against the hammer 11. Hammer 11 is operated by a helical spring 9 through a pivotable linkage 10. The hammer 11 rotates upwardly to strike the firing pin 33, moving it into contact with the primer of a shell loaded within the shell chamber housing 6, thereby causing the gun to fire.

The recoil associated with firing the gun causes the entire gun barrel assembly to reciprocate rearwardly. As this happens, the hammer 11 is forced out of the hammer slot 23 in the bolt 27 and is returned to its cocked position. Rearward movement of the gun barrel assembly applies rearwardly-extending force on the helical spring 1. The cable 3 is also pulled rearwardly with the gun barrel assembly and is rotated over fixed pulley 4 and travelling pulley 8, pulling the reciprocating sleeve 2 forwardly. Forward movement of the reciprocating sleeve 2 transfers forwardly-extending force onto helical spring 1. In this manner, the helical spring 1 is extended in both directions simultaneously. Because of the compound pulley arrangement provided, the reciprocating sleeve 2 is moved forwardly approximately one half of the distance that the gun barrel assembly is moved rearwardly. Because force is applied to the helical spring 1 in opposite directions at different rates, the spring 1 absorbs the recoil energy at an increasing rate.

It is considered to be within the scope of this invention to rearrange the various parts of the recoil-redirecting mechanism such that the spring means is a helical spring which absorbs recoil energy by compression, rather than by extension. In such an embodiment, a helical compression spring would be situated forwardly of the reciprocating sleeve 2 and rearwardly of its attachment to the gun barrel assembly. Recoil of the gun barrel assembly would apply rearwardly-directed compressive force to the spring and would cause the reciprocating sleeve 2 to exert forwardly-directed compressive force on the spring. It is also considered to be within the scope of this invention that the spring means be any suitable energy-absorbing material or device. For example, the spring means could be a resiliently elastic material, such as rubber, which absorbs energy either by compression or extension. The spring means may also be a metallic spring of any suitable configuration or maybe a hydraulic spring or shock absorber.

According to another aspect of the invention, the gun barrel assembly may be latched or held substantially at its rearwardmost position either before or after firing of the gun. Referring again to FIG. 1, a pivotable receiver catch 15 is mounted at the rearward end of the frame 17. The receiver catch 15 is positioned to engage the longitudinal guide 24 of the receiver 28 when the gun barrel assembly reaches substantially its rearwardmost position. The receiver catch 15 is biased by helical spring 16 and is operated by transfer bar 14*a*.

As described above, the gun may be fired with the gun barrel assembly originating at its forwardmost position. When the trigger 13 is squeezed, it bares against the lip 14*b* of the transfer bar 14*a* which simultaneously operates the hammer catch 12 and receiver catch 15. Retraction of the hammer catch 12 allows the hammer 11 to strike the firing pin 33, thereby firing the gun. As the gun barrel assembly recoils and the recoil energy is redirected to and absorbed by the spring means, the gun barrel assembly will be returned to its forwardmost position if the trigger 13 is held in a squeezed position such that the receiver catch 15 is held at its downwardly-pivoted position. If the trigger 13 is immediately released after firing, the receiver catch 15 is returned to its upward position and will engage the longitudinal guide 24 of the receiver 28 as the gun barrel assembly substantially reaches its rearwardmost position. The receiver catch 15 will hold the gun barrel assembly at this rearward position after firing rather than allowing it to return to its forwardmost position. If desired, the gun may be reloaded and refired with the gun barrel assembly at the rearwardmost position. Alternatively, the gun barrel assembly may be moved manually to the rearwardmost position prior to firing.

From the rearward latched position, when the trigger 13 is squeezed, receiver catch 15 is pivoted to allow the gun barrel assembly to slide forwardly being biased by the energy stored in the spring means. Just prior to the gun barrel assembly reaching its forwardmost position, at which the longitudinal guides 24 would contact the stop plates 18, the hammer 11 is allowed access to strike the firing pin 33 through the bolt slot 23. This will cause the gun to fire as the gun barrel assembly is in a forward motion and then cause recoil energy to again be transferred to and stored by the spring means.

Another undesirable byproduct of the recoil associated with firing a gun is muzzle climb. Because most hand-held and mounted guns are supported at a point below the horizontal center of the gun's barrel, rearward recoil against the supports cantilevers the muzzle end of the barrel upwardly. According to another aspect of the present invention, the recoil-redirecting mechanism at least partially counteracts muzzle climb by providing the reciprocating block or sleeve 2 with a mass of predetermined size. In preferred form, the center of gravity of the mass would be positioned directly above the horizontal center of the barrel 7. When the block or sleeve 2 is slid forwardly in response to the firing of the gun, the mass forwardly counterbalances the gun by shifting its center of gravity toward the muzzle of the barrel 7.

According to another aspect of the invention, muzzle climb may be further counteracted by providing the frame 17 with an upwardly-extending portion which terminates at an outward end that is situated radially above the barrel 7. In the illustrated embodiment, this portion is provided by the guide sleeve 5. The guide sleeve 5 is positioned such that the reciprocating sleeve 2 will contact the guide sleeve 5 as the gun barrel assembly reaches or nears its full recoil stroke. The reciprocating sleeve 2 has an obliquely-formed forward edge such that only the uppermost portion of the reciprocating sleeve 2 will contact the uppermost portion or outward end of the guide sleeve 5. The forwardly-directed force exerted against the guide sleeve 5 at a point above the horizontal center of the barrel 7 causes a cantilevered downward force to be applied to the forward end of the gun. This, at least partially, counteracts the above-described muzzle climb associated with the recoil of firing the gun.

According to another embodiment of the invention, the gun may be provided with a fixed barrel and receiver and a recoil-redirecting mechanism which operates through a blow-back bolt. The operation of the recoil-redirecting mechanism is essentially identical to that described above except that the spring means and cable 3 are attached at one end to the bolt alone which recoils in response to firing the gun. The same principles of increasing absorption of recoil force will apply to this embodiment.

The illustrated gun is a 12-gauge, single-shot shotgun. It is to be understood that it is within the scope of the present invention to provide the same recoil-redirecting mechanism on a rifle using either center-fire or rim-fire cartridges. A gun including this mechanism may also be adapted to include an automatic reloading mechanism so that the gun may be fired in either a semi-automatic or fully-automatic mode. The illustrated and above-described gun represents the best mode of carrying out the invention known to the inventor at the present time. Many variations may be made in the form and structure of this gun to provide a recoil-redirecting and absorbing mechanism which is still within the spirit of the present invention. Therefore, any patent protection granted to me is not to be determined by the illustrated and described embodiment, but rather by the following claim or claims interpreted according to accepted doctrines of claim interpretation, including the doctrine of equivalents.

What is claimed is:

1. A recoil redirecting gun, comprising:

a frame;

a gun barrel assembly including a barrel and a receiver having a bolt therein;

said gun barrel assembly being slidably mounted to longitudinally reciprocate on said frame between a forwardmost position and rearwardmost position;

a means for firing said gun when said gun barrel assembly is substantially at its forwardmost position; and a recoil redirecting mechanism including a recoil-absorbing spring means, a fixed pulley mounted on said frame, a travelling pulley mounted on a longitudinally reciprocating block, said block being longitudinally slidable relative to said frame substantially parallel to and independent from said gun barrel assembly;

a cable means having a first end fixed relative to said frame, said cable means extending around and reversed in direction by said travelling pulley, further extending around and reversed in direction by said fixed pulley, and having a second end fixed to said gun barrel assembly; and said spring means biasing said gun barrel assembly and said reciprocating block so that, when said gun is fired, said gun barrel assembly recoils rearwardly exerting rearwardly-directed force on said spring means and said second end of said cable means, said cable means in turn exerting force on said pulleys to thereby cause said block to slide forwardly and to exert forwardly-directed force on said spring means.

2. The gun according to claim 1, wherein said spring means is positioned rearward of said reciprocating block such that movement of said block and said gun barrel assembly associated with firing said gun exerts extending force on said spring means.

3. The gun according to claim 2, wherein said spring means includes a helically-coiled spring.

4. The gun according to claim 1, wherein said reciprocating block is selected to have a mass of predetermined size such that when said block is slid forwardly in response to the firing of said gun, said mass forwardly counterbalances said frame to at least partially counteract muzzle climb associated with firing said gun.

5. The gun according to claim 1, wherein said frame includes an upwardly-extending portion having an outward end situated radially above said barrel and positioned such that said reciprocating block will contact said portion at said outward end as it slides forwardly to transfer forwardly-directed force to said portion thereby at least partially counteracting muzzle climb associated with firing said gun.

6. The gun according to claim 1, further comprising a means for holding said gun barrel assembly at said rearwardmost position with said spring means in an energy-storing position such that when said gun barrel assembly is released, it is biased by said spring means to slide forwardly and said firing means operates to fire said gun when said gun barrel assembly substantially reaches its forwardmost position.

* * * * *

UNITED STATES PATENT AND TRADEMARK OFFICE

CERTIFICATE OF CORRECTION

PATENT NO. : 5,014,595

DATED : May 14, 1991

INVENTOR(S) : Fredric D. Ducolon, Jr.

It is certified that error appears in the above-identified patent and that said Letters Patent is hereby corrected as shown below:

Col. 2, line 51, delete the comma after "barrel".

Col. 3, line 31, delete ",.".

Col. 4, line 20, there is a period after "27".

Col. 5, line 16, delete the period before "compression".

Claim 1, col. 7, line 16, there is a colon after "including".

Signed and Sealed this

Fifteenth Day of December, 1992

*Attest:*

*Attesting Officer*

DOUGLAS B. COMER

*Acting Commissioner of Patents and Trademarks*